US010882204B2

(12) United States Patent
Beckonert

(10) Patent No.: US 10,882,204 B2
(45) Date of Patent: Jan. 5, 2021

(54) DEVICE FOR SEPARATING A TUBULAR WEB

(71) Applicant: Windmöller & Hölscher KG, Lengerich (DE)

(72) Inventor: Werner Beckonert, Emsdetten (DE)

(73) Assignee: Windmöller & Hölscher KG, Lengerich (DE)

( * ) Notice: Subject to any disclaimer, the term of this patent is extended or adjusted under 35 U.S.C. 154(b) by 340 days.

(21) Appl. No.: 14/774,274

(22) PCT Filed: Jan. 29, 2014

(86) PCT No.: PCT/EP2014/051735
§ 371 (c)(1),
(2) Date: Sep. 10, 2015

(87) PCT Pub. No.: WO2014/139722
PCT Pub. Date: Sep. 18, 2014

(65) Prior Publication Data

US 2016/0031113 A1 Feb. 4, 2016

(30) Foreign Application Priority Data

Mar. 11, 2013 (DE) ..... 10 2013 102 414

(51) Int. Cl.
*B26D 1/02* (2006.01)
*B26D 1/03* (2006.01)
(Continued)

(52) U.S. Cl.
CPC ..... *B26D 7/2628* (2013.01); *B26D 1/025* (2013.01); *B26D 1/035* (2013.01); *B26D 3/001* (2013.01);
(Continued)

(58) Field of Classification Search
CPC ..... B26D 7/14; B26D 7/2628; B26D 1/02; B26D 1/025; B26D 1/03; B26D 1/035;
(Continued)

(56) References Cited

U.S. PATENT DOCUMENTS 1,640,833 A * 8/1927 Judelshon ..... D06H 7/08 26/82
2,894,106 A * 7/1959 Jacob et al. ..... B26F 3/12 200/61.18
(Continued)

FOREIGN PATENT DOCUMENTS

DE 7200203 4/1973
JP 43-002702 2/1968
(Continued)

OTHER PUBLICATIONS

Notification of Office Action and Search Report dated Jul. 25, 2016 From the State Intellectual Property Office of the People's Republic of China Re. Applciation No. 201480014279.7 and Its Translation of Office Action Into English.
(Continued)

*Primary Examiner* — Clark F Dexter

(57) ABSTRACT

The invention relates to a Device (10) for separating a tubular web (11) in two flat webs (12, 13) with an adjustable blade (20) for cutting the tubular web (11) and with a pulling device (30) which impinges the blade (20) with a tensile force (K) on a folding edge (14) of the tubular web (11) wherein the pulling device (30) is configured in a way that the tensile force (K) is adjustable depending on the tubular properties of the tubular web (11) and that the tensile force (K) can be mainly kept constant with constant tubular properties independent from the tubular web (11).

7 Claims, 1 Drawing Sheet

(51) Int. Cl.

| | |
|---|---|
| ***B26D 3/00*** | (2006.01) |
| ***B26D 7/14*** | (2006.01) |
| ***B26D 7/26*** | (2006.01) |
| ***B65H 35/02*** | (2006.01) |

(52) U.S. Cl.
CPC ..... *B26D 7/14* (2013.01); *B65H 35/02* (2013.01); *B65H 2701/1752* (2013.01); *Y10T 83/343* (2015.04); *Y10T 83/386* (2015.04); *Y10T 83/391* (2015.04); *Y10T 83/6584* (2015.04); *Y10T 83/73* (2015.04); *Y10T 83/8776* (2015.04)

(58) Field of Classification Search
CPC .... B26D 3/001; B26D 7/2635; B26D 7/2642; D06C 7/08; B65B 61/06; B65B 61/08; B65B 61/10; B65H 35/02
USPC ..... 26/82; 83/17, 18, 20, 21, 176, 179, 180, 83/184, 425, 431, 440, 582
See application file for complete search history.

(56) References Cited

U.S. PATENT DOCUMENTS

| | | | | | |
|---|---|---|---|---|---|
| 2,923,194 | A | | 2/1960 | Ambler et al. | |
| 3,009,200 | A | * | 11/1961 | Voigt | B26D 3/001 19/258 |
| 3,068,730 | A | * | 12/1962 | Johnson | B26D 3/001 26/82 |
| 3,472,048 | A | * | 10/1969 | Shaw et al. | D04B 35/34 112/63 |
| 3,789,713 | A | * | 2/1974 | Peters | B26D 3/001 26/82 |
| 3,808,992 | A | * | 5/1974 | Mall | D05B 35/00 112/122.3 |
| 3,964,409 | A | * | 6/1976 | Mall et al. | D05B 37/08 112/470.18 |
| 4,219,911 | A | * | 9/1980 | Henning | D04H 1/74 19/161.1 |
| 5,060,587 | A | * | 10/1991 | Biesinger | D06H 5/005 112/475.01 |

FOREIGN PATENT DOCUMENTS

| | | |
|---|---|---|
| JP | 47-024686 | 11/1972 |
| JP | 57-167813 | 10/1982 |
| JP | 60-026958 | 8/1985 |
| JP | 04-187421 | 7/1992 |
| WO | WO 2014/139722 | 9/2014 |

OTHER PUBLICATIONS

International Preliminary Report on Patentability dated Feb. 17, 2015 From the International Preliminary Examining Authority Re. Application No. PCT/EP2014/051735.

International Search Report and the Written Opinion dated May 19, 2014 From the European Patent Office Re. Application No. PCT/EP2014/051735 and Translation of Search Report in English.

Request for Examination [Pruefungsantrag] dated Dec. 16, 2014 From the German Patent and Trademark Office [Deutsches Patent—und Markenamt] Re. Application No. 102013102414.9.

Request for Examination [Pruefungsantrag] dated Sep. 25, 2013 From the German Patent and Trademark Office [Deutsches Patent—und Markenamt] Re. Application No. 102013102414.9.

Translation dated Sep. 10, 2015 of Request for Examination [Pruefungsantrag] dated Dec. 16, 2014 From the German Patent and Trademark Office [Deutsches Patent—und Markenamt] Re. Application No. 102013102414.9.

Translation dated Sep. 10, 2015 of Request for Examination [Pruefungsantrag] dated Sep. 25, 2013 From the German Patent and Trademark Office [Deutsches Patent—und Markenamt] Re. Application No. 102013102414.9.

* cited by examiner

DEVICE FOR SEPARATING A TUBULAR WEB

RELATED APPLICATIONS

This application is a National Phase of PCT Patent Application No. PCT/EP2014/051735 having International filing date of Jan. 29, 2014, which claims the benefit of priority German Patent Application No. 10 2013 102 414.9 filed on Mar. 11, 2013. The contents of the above applications are all incorporated by reference as if fully set forth herein in their entirety.

FIELD AND BACKGROUND OF THE INVENTION

The invention relates to a device for separating a tubular web into two flat webs.

Devices for separating tubular webs into two flat webs respectively are known during the production of tubular webs from plastic film in a blow process. The film is thereby produced in a form of a tubular web and is laid flat for the removal. Thereby, two layers are configured which have to be separated for further processing. Common devices for separating tubular webs into flat webs therefor comprise an adjustable blade which is directed to a folding edge of the tubular web. According to the order plastic films with different widths and properties are demanded, further during the course of one and the same order differences in the tubular widths and the tubular properties can result. Thereby, the need exists that the blade is impinged with an appropriate tensile force for cutting of a certain tubular web and that the blade achieves a possibly even cut, independently from the tubular width. In order to position the blade against the folding edge, devices are known with a rotational spring which can interfere at the blade with a stretched rope and press the blade against the folding edge. With these devices however it has turned out as a disadvantage that the tensile force at the blade cannot be adjusted by a rotational spring. Further it has turned out as a disadvantage that the tensile force at the blade alters during uncoiling and coiling of the rotational spring from the cylinder and partly is subject to hysteresis. In case the blade is pressed against the folding edge more intensely than necessary it can lead to the fact that the film is damaged or even ruptures. In case the tensile force at the blade is low it can happen that the blade does not exactly strike the folding edge and the flat web is not cut evenly. Further, it is disadvantageously with the known devices that a data memory is not possible from order to order and that the desired tensile force cannot be reproduced.

SUMMARY OF THE INVENTION

Therefore, it is the object of the present invention to provide an improved device for cutting a tubular web into two flat webs which avoids the previously described disadvantages and enables an exact separation line of the flat webs. Particularly, the device should adjust and be able to reproduce an optimal tensile force at the blade. The object of the present invention is solved by all features of claim 1. In the dependent claims possible embodiments of the invention are described.

The invention intends a device for separating a tubular web into two flat webs which is configured with an adjustable blade for cutting of the tubular web and with a pulling device which impinges the blade with the tensile force to the folding edge of the tubular web, wherein the pulling device is configured in a way that the tensile force can be adjusted in dependence of the tubular probabilities of the tubular web and that the tensile force can be kept constant with constant tubular probabilities independently from the tubular width of the tubular web. By tubular properties according to the invention tubular thickness and tubular hardness have to be understood.

On the one hand, during the production of the film certain tubular properties like for example tubular thickness and tubular hardness are desired. For each special order the invention can allow to adjust the tensile force, meaning to adjust a suitable tensile force at the blade which is appropriate for cutting a tubular web with certain tubular properties. On the other hand, it can occur in the production of the tubular web from plastic film that the tubular width and also the tubular properties vary during the order. Therefore, it can occur that the tubular web is not cut evenly or is not cut at all. All that leads to production delays and production errors. In order to overcome these problems the invention proposes to compensate the variations in the tubular properties by adjusting and the variations in the tubular width by keeping the tensile force at the blade. If the width or the hardness of the tubular web varies by an unchanging tubular width, according to the invention the tensile force at the blade has to be adjusted accordingly in order to preferably cut the thicker or thinner, harder or more elastic tubular web. If however the tubular width increases with constant tubular properties, according to the invention the tensile force has to be kept constant at the blade in order to achieve an optimal cutting result. Therewith, it can be achieved that the tubular web is cut with an appropriate tensile force with one and the same device from order to order and during one order is cut in two flat webs preferably evenly.

The device according to the invention therewith provides a pulling device with which the tensile force can be adjusted easily according to the tubular properties and which remains constant during alterations of the tubular width. With adjusting a tensile force at the blade the invention ensures that the blade actually cuts the tubular web that the tubular web is not ruptured and is not tangled at the blade. With keeping the tensile force at constant tubular properties the invention allows that the blade is perfectly positioned according to the folding edge of the tube in order to counteract alterations in the tubular width during a running web. This involves the advantage that the tubular webs with different properties and different widths are cut with an even cut into flat webs. Therewith, the production results can be improved, the production waste can be reduced and the performance of the production from flat webs from plastic film can be significantly improved.

According to the invention the pulling device is configured with a pneumatic cylinder which can serve for adjusting and/or keeping the tensile force at the blade. Advantageously, the pneumatic cylinder enables a continuous and therewith a particularly precise adjustment of the tensile force at the blade. The tubular web acts on the blade depending on the thickness and/or the hardness of the tubular web with an alterable force which is opposed to the tensile force through the pulling device. Due to the compressibility of the compressed air in the pneumatic cylinder an elastic and flexible adjustment of the tensile force at the blade can be achieved. For a new order with alterations of the tubular properties and within one and the same order with variations of the tubular properties only the pressure level in the pneumatic cylinder has to be adapted. The pneumatic cylinder therewith ensures that the device according to the invention can be used flexibly for different orders for tubular webs with different properties.

Moreover, the pneumatic cylinder is particularly appropriate to compensate the alterations in the tubular width during constant tubular properties quickly within one order. If the tubular width alters, the tensile force at the blade alters. The blade is in an operative mechanical connection with the pneumatic cylinder in a way that when the tensile force at the blade alters, the pressure in the pneumatic cylinder alters likewise. By supply or release of compressed air the pressure level in the pneumatic cylinder can be adjusted quickly in order to restore the desired pressure in the pneumatic cylinder and thereby maintain the desired tensile force at the blade. Advantageously, only the pressure level in the pneumatic cylinder has to be maintained in order to realize an optimal possibly constant tensile force at the blade and therewith an optimal cutting irrespectively of the tubular width. The pneumatic cylinder according to the invention is preferably with low friction and requires no keeping of the blade during constant tubular width and constant tubular properties. Alternatively, it can be intended that instead of the pneumatic cylinder a hydraulic drive or an electric drive can be used.

Advantageously, the pulling device according to the invention can comprise a transmission mechanism in order to transmit the effect of the pneumatic cylinder to the blade. Therewith, it can be ensured that the tensile force can be adjusted even more exactly at the blade wherein at the same time relatively great adjustable ranges of the blade can be realized. Likewise, the forces which are exerted on the blade by tubular webs of different widths can be absorbed even faster. The transmission mechanism advantageously ensures that the tensile force at the blade is flexible and is not subject to great variations so that the tubular web is likewise not damaged by an alteration of the tubular width.

According to the invention the pneumatic cylinder can be connected to the transmission mechanism via a first drag rope wherein the transmission mechanism can be connected with the blade via a second drag rope. Advantageously, the first and the second rope can be produced from rigid material which is not flexible and does not comprise hysteresis. Therewith, it can be achieved that the tensile force is saved optimally and can be exactly reproduced by adjusting of an appropriate pressure in the pneumatic cylinder. Further it is an advantage that the tensile force is provided with a linear characteristic curve in dependence of the pressure so that the tensile force can be adjusted precisely.

Thereby, the transmission mechanism in form of a rotary disc can be configured with a first belt idler which is coiled to a first drag rope and with a second belt idler on which the second belt rope is coiled. Advantageously, the first belt idler can comprise a diameter which is smaller than the diameter of the second belt idler. According to the invention therewith an optimal transmission ratio can be achieved so that the possible adjusting range of the blade can be increased in comparison to the stroke of the pneumatic cylinder about the factor about which the diameter of the second belt idler exceeds the diameter of the first belt idler. The tensile force at the second drag rope can in turn be smaller about the same factor than the force at the first drag rope. Therewith, with a relatively small commercially available pneumatic cylinder relatively small tensile forces at the cleaver and at the same time great adjusting ranges of the blade can be enabled. Therewith, the device provides a simple and cost efficient solution in order to significantly improve the cutting result.

The transmission mechanism according to the invention can be pivotably mounted at a housing of the device. The transmission mechanism can thereby be mounted at the simple swivel joint and therewith it can be mounted particularly easily. Further, the device can intend a first deflection roller for adjusting the first drag rope and the second deflection roller for adjusting the second drag rope vertically to the running direction of the tubular web. Advantageously, the first drag rope can be adjusted parallelly to the pneumatic cylinder and can be adjusted directly at the piston of the pneumatic cylinder. The transmission mechanism can thereby optimally transmit the tensile forces between the pneumatic cylinder and the blade via the deflection rollers.

According to the invention the tubular web can be guided via a deflection roller to the blade which can be adjusted mainly perpendicularly to the running direction of the tubular web. According to a particular advantage of the invention two flat webs can be led to two separated coiling devices and can be coiled there after cutting of a tubular web.

The blade according to the invention can be moveably assembled on a guidance rail using a slide element. Hereby, the guide rail can be assembled mainly perpendicular to the running direction of the tubular web. Thus, the blade can be adjusted perpendicularly to the running direction of the tubular web in order to better cut the tubular web with different widths and thicknesses according to the invention. The blade can preferably comprise a longitudinal extension parallel to the running direction of the tubular web in order to enable an optimal cutting along the folding edge.

Further it can be essential for the invention that the pneumatic cylinder is assembled on the guidance rail. Herewith, it can be ensured that the tensile force can be optimally transmitted to the blade. Alternatively, it is also possible that the pneumatic cylinder is assembled at the housing of the device. In both embodiments the pneumatic cylinder can be assembled outside of the tube so that the pressure air connections and the pneumatic cylinder are freely accessible for possible maintenance or control during a running web.

Likewise it can be intended according to the invention that the blade comprises at least one, particularly two blade elements. Advantageously, the second blade element can serve as an additional security that the material can be actually cut with a greater thickness and a greater hardness. On the other hand the second blade element can ensure that during the running web one of the blade elements is always ready for cutting the tubular web during a running web, also when the other blade element has to be exchanged or repaired.

The blade element can according to the invention be configured as a round plate shear blade or such like. The round plate shear blade can advantageously comprise a rotating round plate for guiding the tubular web and a cutting edge for cutting the tubular web. Advantageously, the round plate can be positioned within the tubular web wherein the cutting edge can be assembled outside of the tubular web. Therewith, it can be ensured that the cutting edge can lie outside of the tubular web and is easily accessible and can be exchanged by a running tubular web. The material of the tubular web can be inserted between the rotating round plate and the cutting edge for cutting. Thereby the round plate can roll off at the cutting edge, wherein the material can be pressed at the sharp cutting edge through the round plate in order to cut the tubular web lying in between.

Advantageously, the pulling device according to the invention, particularly the pneumatic cylinder, can be automatically controlled when the tubular properties and/or the tubular width alter. For controlling the tubular probabilities corresponding sensors can be intended. In order to register if the tubular web alters the pressure in the pneumatic cylinder can be monitored. Advantageously, the first drag rope can be adjusted directly at the piston of the pneumatic cylinder which connects the pressing device with the pneumatic cylinder. When the tubular width is increasing the tubular material presses to the blade with a decreasing force and the force with which the first drag rope pulls at the piston is thereby untightened. Then pressure within the pneumatic cylinder decreases and can be used as a signal for turning on of the pulling device, particularly of the pneumatic cylinder. Then compressed air can be inserted at the piston side of the pneumatic cylinder, the piston rod is thereby retracted in the pneumatic cylinder, the first drag rope is stressed again and is uncoiled from the small belt idler while the rotary disc turns into direction of the pneumatic cylinder. Thereby, the second drag rope is coiled to the large belt idler and the second drag rope pulls the blade against the folding edge of the broadened tubular web. If the tubular width is getting smaller during the production only the blade is moved into the inside. Thereby, the second drag rope is uncoiled from the large belt idler and the rotary disc turns towards the blade. Thereby, the first drag rope is coiled to the small belt idler and the piston rod is pulled out of the pneumatic cylinder. The pressure in the pneumatic cylinder increases. Thereby, the compressed air can be blown out of the pneumatic cylinder by a specially controlled compressed air connection until the desired pressure is again reached within the cylinder which corresponds to the optimal tension force at the blade. An optimal pressure in the cylinder can thereby be kept constant during consistent tubular properties whereas the optimal pressure alters if the tube probabilities like tube pressure or tube hardness alter. The device according to the invention can intend sensors which monitor the tube properties and can detect the alteration of the tube properties by means of which new values for the optimal pressure in the pneumatic cylinder and for the tensile force at the blade can be calculated.

According to the invention the pressure in the pneumatic cylinder can be controlled in dependence of the tube properties. The pulling device can thereby comprise a pressure regulator in order to adjust or keep the pressure constant within the pneumatic cylinder by supply or release of the compressed air. Further, the pneumatic cylinder can comprise a compressed air connection at the piston side in order to supply or release the compressed air. If with constant tubular properties the pressure within the pneumatic cylinder is kept constant, the tensile force at the blade remains likewise mainly constant. According to the invention it has turned out that the cutting result is optimal when with constant tubular properties the tensile force at the blade is mainly adjusted constant independently from the tubular width.

Advantageously, the pulling device can comprise a control device for controlling the tensile force at the blade in dependence of the tubular probabilities. Further, the control device can be in data communication with the sensors and/or the pressure regulator and/or the compressed air connection. Advantageously, the pulling device can automatically control the tensile force at the blade. According to the invention the control device can adjust the tensile force at the blade dependent from the tubular properties like tubular thickness and tubular hardness wherein with constant tubular properties the control device can likewise keep the tensile force at the blade constant. Therefor, the control device can adapt or keep the pressure in the pneumatic cylinder constant by compressed air supply and/or release.

Advantageously, the blade can be adjusted by the pulling device in case the tubular width of the tubular web increases. If however the tubular width of the tubular web decreases, the blade itself can be adjusted by the tubular web. Advantageously, the pulling device can only adjust the blade in one direction so that flexible drag ropes can be used which only have to be stretched in one direction. Further, the pneumatic cylinder can only be used with one piston side compressed air connection. Thereby, the control and the assembly of the device according to the invention can be facilitated.

BRIEF DESCRIPTION OF THE SEVERAL VIEWS OF THE DRAWINGS

Further advantages, features and details of the invention result from the subsequent description in which multiple embodiments are described in detail in relation to the drawings. Thereby, the described features in the claims and in the drawings can be essential for the invention each single for themselves or in any combination. It is shown:

DESCRIPTION OF SPECIFIC EMBODIMENTS OF THE INVENTION

Figure 1:
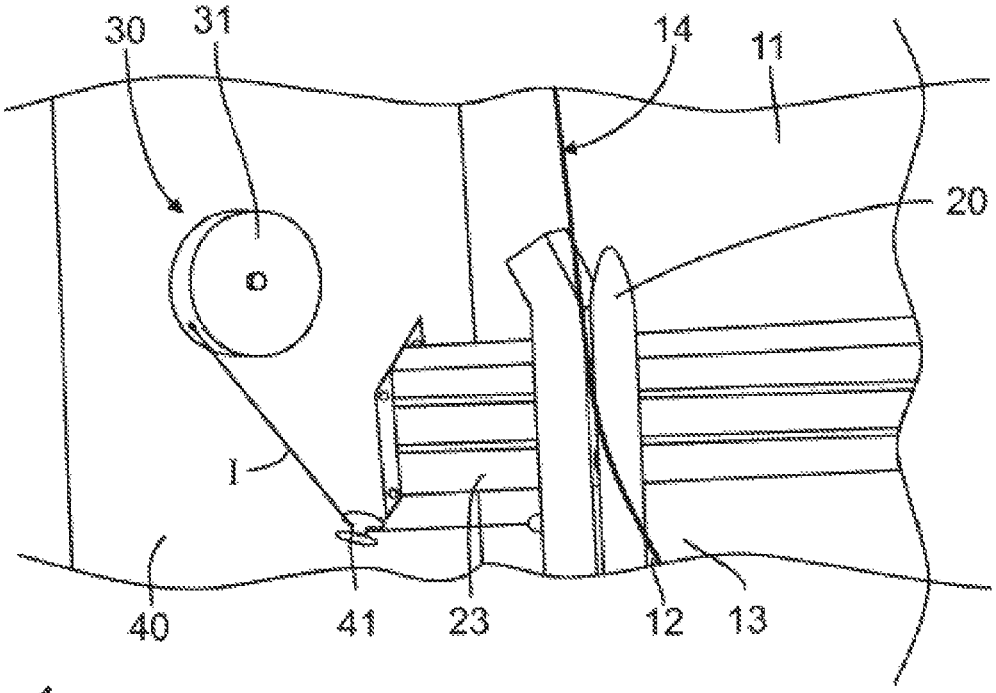
FIG. 1 a schematic drawing of a common device.

FIG. 1 shows a device for separating a tubular web 11 in two flat webs 12, 13 like they are known from the state of the art. This device is configured with an adjustable blade 20 which is directed to a folding edge 14 of the tubular web 11. The blade 20 can be shifted along a guidance rail 23 which extends perpendicularly to the running direction of the tubular web 11. When the tubular web 11 is broadened the blade 20 shall be shifted to the left. If the tubular web 11 is getting smaller, the blade 20 shall be shifted to the right in order to meet the folding edge 14. The device from FIG. 1 intends therefor only that the blade 20 according to the tubular web 11 in the direction towards the outside, in the picture towards the left, is impinged. The device thereby comprises a pulling device 30 with a rope drum 31 and a drag rope I which is guided to the blade 20 via a deflection roller 41. The drag rope I remains always stretched and pulls the blade 20 towards the left. However, thereby the disadvantage occurs, that the tensile force is subject to alterations and a hysteresis by the rope drum 31 during coiling or uncoiling of the drag rope I from the rope drum 31. The tension force can further not be specifically adjusted and also the tensile force does not alter due to the properties of the rope drum 31. Further it is disadvantageous that from order to order a storage of the data is not possible with which tensile force by which tubular web properties the optimal cut can be achieved.

Figure 2:
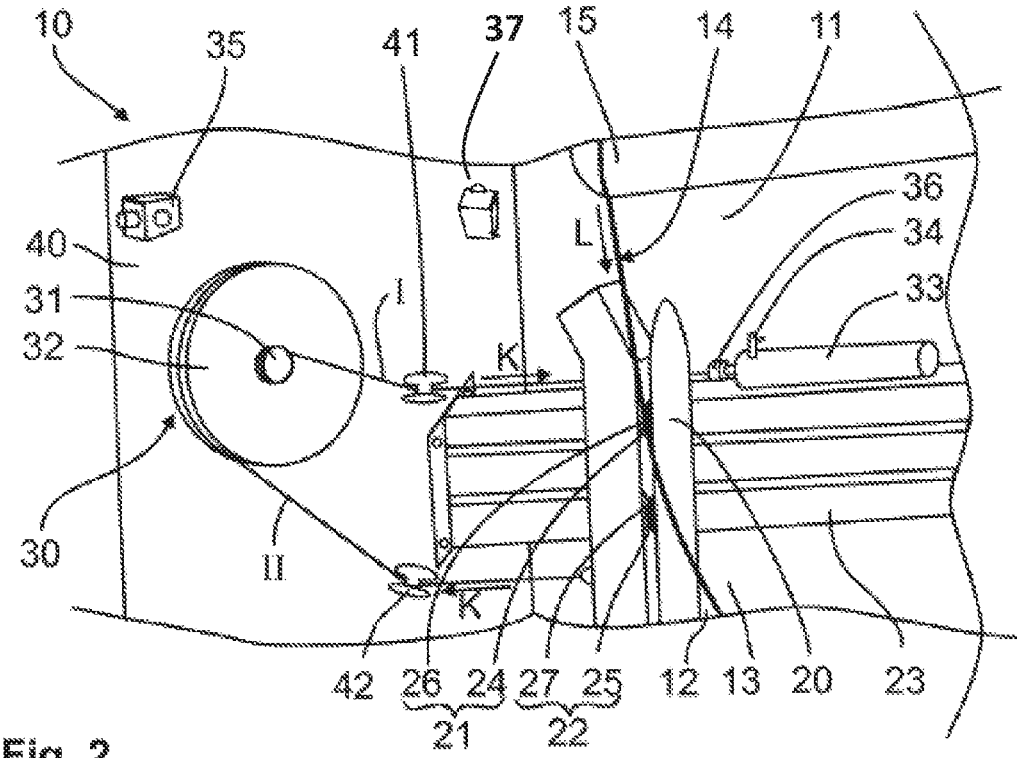
FIG. 2 a schematic drawing of the device according to the invention.

FIG. 2 shows the device 10 according to the invention for separating a tubular web 11 into flat webs 12, 13 which comprises an adjustable blade 20 for cutting the tubular web 11 and a pulling device 30 which impinges the blade 20 with an adjustable tensile force K toward a folding edge 14 of the tubular web 11 wherein the tensile force K can be adjusted according to the tubular properties. The pulling device 30 according to the invention is configured in a way that the tensile force K remains mainly constant independently from the tubular width of the tubular web 11 with constant tubular properties. Thereby, it is essential for the invention that the blade 20 is positioned exactly with an accurately adjusted tensile force K regarding the folding edge 14 of the tube 11 in order to achieve an even line between the flat webs 12, 13 and to avoid a production error when the tubular web 11 is not accurately separated or even ruptured.

The pulling device 30 comprises a pneumatic cylinder 33 according to the invention which serves for adjusting and/or holding of the tensile force K at the blade 20. Using the pneumatic cylinder 33 the tensile force K can be continuously adjusted or kept at the blade 20 in dependence of the tubular properties. Likewise, the force which the tubular web 11 performs to the blade 20 itself can be retained optimally by the pneumatic cylinder 33. Thereby, the blade 20 can be adjusted until the tensile force K comprises an optimal strength for cutting the film or web 11. By a refilling or release of the compressed air in the pneumatic cylinder 33 the tensile force K can be kept almost constant at the blade 20 with constant tubular properties. If the broadening tubular web 11 acts on the blade 20 with a decreasing force the compressed air can be led into the pneumatic cylinder 33 in order to increase the tension at the blade 20 towards the force of the tubular web 11 until the blade 20 reaches the position by which the tensile force K is in accordance with the desired value. The tubular web 11 can thereby be cut even independently from its width with a suitable almost constant tensile force K. The material of the tubular web 11 is thereby preferably saved and the flat webs 12, 13 achieve a possibly even separation line. The pneumatic cylinder 33 can be used for different orders. For each new order or when alterations of the tubular web properties occur within one order the pressure level in the pneumatic cylinder 33 can be adapted by a supply or a release of the compressed air, which corresponds to the optimal tensile force K at the blade 20 which leads to a preferably even cut. The pneumatic cylinder 33 can thereby be controlled quickly so that alterations of the tubular thickness and the tubular stiffness and the tubular width can be compensated also during one order. The pneumatic cylinder 33 according to the invention comprises small friction losses, requires less energy for controlling and further requires no keeping of the blade 20 with a constant tensile force K, tubular width and tubular properties. Instead of the pneumatic cylinder 33 alternatively a hydraulic drive or an electric drive can be used.

The pulling device 30 according to the invention further comprises a transmission mechanism 31, 32 which transmits the effect of the pneumatic cylinder 33 to the blade 20 with a transmission factor D/d. The transmission mechanism 31, 32 is configured in form of a rotary disc 31, 32 with a first cable drum 31 on which a first drag rope I is coiled and with a second cable drum 31 on which a second drag rope II is coiled. The first cable drum 31 thereby comprises a diameter d which is smaller than a diameter D of the second cable drum 32. Advantageously, therewith a transmission ratio D/d can be achieved which increases the possible adjusting range of the blade 20 compared to the stroke of the pneumatic cylinder 33 about the factor D/d.

The pneumatic cylinder 33 is thereby connected with the first cable drum 31 using the first drag rope I wherein the second cable drum 32 is connected with the blade 20 via the second drag rope II. The first I and the second drag rope II can be produced from solid, not flexible material so that the hysteresis effects can be avoided. The tensile force K at the second drag rope II can be decreased about the ratio d/D by the transmission mechanism 31, 32 as a force at the first drag rope I. Therefore, relatively small accurate tensile forces can be achieved at the blade 20 while the adjusting range of the blade 20 can be increased at the guidance rail 23. Therefore, the blade 20 can comprise a not shown sliding element in order to be shifted along the guidance rail 23 perpendicular to the running direction L of the tubular web 11. Advantageously, a very accurate tensile force K can be adjusted at the blade 20 wherein the blade 20 can be adjusted relatively far at the guidance rail 23. Therewith, the forces can be absorbed even faster and more accurately which the tubular webs 11 with different widths perform to the blade 20. The transmission mechanism 31, 32 enables a flexible keeping of the tensile force K together with the pneumatic cylinder 33 in reaction to alterations of the tubular width so that the tubular web 11 is not damaged.

The pulling device 30 according to the invention further enables that the optimal tensile force K can be determined and saved for the different tubular probabilities. This optimal tensile force K can be further reproduced exactly by adjusting of the appropriate pressure in the pneumatic cylinder 33. Thus, for different orders the optimal tensile force K can be registered in order to be saved according to tubular properties like tubular thickness and/or hardness as a recipe. Further, the tensile force K can be kept possibly constant according to the width of the tubular web 11 within the scope of one order by controlling the pressure in the pneumatic cylinder 33. Therefore, alterations of the tubular properties and tubular widths can be absorbed quickly, selectivity and elastically from order to order and also during one order. Advantageously, the tensile force K has a linear characteristic line in dependence from the pressure in the pneumatic cylinder 33 so that the tensile force K can be adjusted precisely and easily.

The transmission mechanism 31, 32 is according to the invention moveably mounted at a housing 40 of the device 10. The device 10 further comprises a first deflection roller 41 which serves for adjusting the first drag rope I in alignment with the pneumatic cylinder 33 and a second deflection roller 42 which serves for aligning the second drag rope II perpendicularly to the blade 20 and parallelly to the guidance rail 23. Advantageously, the first drag rope I is assembled directly at the piston of the pneumatic cylinder 33. The transmission mechanism 31, 32 can therewith transmit the tensile forces between the pneumatic cylinder 33 and the blade 20 by the deflection rollers 41, 42 and the drag ropes I, II. According to the invention, the tubular web 11 is guided to the blade 20 via a deflection roller 15 which is adjusted perpendicularly to the running direction L of the tubular web 11 and parallelly to the guidance rail 23. The tubular web 11 can for example be guided to the device 10 according to the invention for cutting for example after the production via the deflection roller 15. Further it is possible that the two flat webs 12, 13 are guided to two separated wrapping devices after separation of the layers of the tubular web 11.

The blade 20 comprises two blade elements 21, 22 according to a preferred embodiment of the invention. Two blade elements 21, 22 preferably serve for availability at all times for cutting of the tubular web 11 during a running web of a blade element 21, 22, also when the other blade element 21, 22 has to be exchanged or repaired. The blade elements 21, 22 according to the invention are configured as round plate shear plates. Each round plate shear plate 21, 22 comprises a rotating round plate 24, 25 for guiding of the tubular web 11 and a cutting edge 26, 27 for cutting of the tubular web 11. The round plates 24, 25 are positioned in a way that the tubular web 11 surrounds them from the outside before cutting wherein the cutting edges 26, 27 remain outside of the tubular web 11. The cutting edges 26, 27, which represent a wearing part, can be positioned freely accessible outside of the tubular web 11 and can be exchanged, if necessary, with a running web. The other blade element 21, 22 with the remaining cutting edges 26, 27 can be used further for cutting of the tubular web 11, also while the other cutting edge 26, 27 is exchanged. The material of the tubular web 11 is inserted between the rotating round plates 24, 25 and the cutting edges 26, 27 for cutting. Thereby, the round plates 24, 25 roll from the cutting edges 26, 27 wherein the tubular web 11 pushes the round plates 24, 25 at the sharp cutting edges 26, 27 and they are cut like within a scissor.

Advantageously, the pulling device 30 according to the invention can be automatically controlled in dependence from the tubular properties and the tubular width. If the tubular properties remain constant, the alteration of the pressure in the pneumatic cylinder 33 can be a sign that the tubular width alters. For controlling the pulling device 30 the pressure in the pneumatic cylinder 33 can be monitored. When the tubular width is increasing and the piston is pulled out of the pneumatic cylinder 33 with a decreasing force, the pressure in the pneumatic cylinder decreases. This is a sign that the tubular width increases and that the pulling device 30 or the pneumatic cylinder 33 have to be switched on. The pneumatic cylinder 33 comprises a compressed air connection 34 on the piston side through which compressed air is led into the pneumatic cylinder 33. The piston rod 36 is then pulled into the pneumatic cylinder 33 and the first drag rope I stretches again. The first drag rope I is coiled from the smaller belt idler 31 and the smaller belt idler 31 is turned to the right together with the rotary disc 31, 32. Thereby, the tension at the second drag rope II is increased and the second drag rope II is coiled to the large belt idler 32 and the blade 20 is pulled to the left. The compressed air supply is then again turned off when the desired pressure is reached in the pneumatic cylinder 33 which corresponds to the optimal tensile force K for the tubular web 11 with the special properties from the present order. Therewith, the tensile force K can be kept almost constant at the blade 20 also while the tubular web 11 is broadened. If the tubular width is decreasing during the production, the blade 20 is moved to the right by the tubular web 11 itself. Thereby, the second drag rope II is uncoiled from the large belt idler 32 and the rotary disc 31, 32 is turned to the left. Thereby, the first drag rope I is coiled on the small belt idler 31 and the piston rod 36 is pulled out of the pneumatic cylinder 33. The pressure in the pneumatic cylinder 33 increases. Then the compressed air is led out of the pneumatic cylinder 33 by the compressed air connection 34 until the desired pressure is again reached in the pneumatic cylinder 33 which corresponds to an optimal tensile force K at the blade 20 for this order. Therefore, the device 10 can comprise a not shown control device in order to counteract alterations of the tubular width by maintaining the pressure within the pneumatic cylinder 33 within the scope of one order. The control device can be in connection with a pressure regulator 35 which is schematically shown in FIG. 2.

For another order by which the tubular web 11 is produced with other properties like the tubular thickness and tubular hardness another pressure in the pneumatic cylinder 33 and another tensile force K at the blade 20 can provide the optimal cutting result. For different orders and different tensile webs 11 the device 10 can save a so called recipe for example in a storage of the control device. The recipe can include which pressure in the pneumatic cylinder 33 and which tensile force K at the blade 20 are optimal for which order or for which tubular webs 11. Further, the invention can intend that during an order the tubular thickness and/or hardness is monitored by conventional sensors 37 in order to adjust the pressure in the pneumatic cylinder 33 and therewith the tensile force K at the blade 20 likewise depending from the properties of the tubular web 11.

In summary the pulling device 30 according to the invention enables an automatic adjustment of the tensile force K at the blade 20 in dependence from the given properties of the tubular web 11. Thereby, it can be possible that the differences in tubular properties are recognized by variations so that the pressure in the pneumatic cylinder 33 and the tensile force K at the blade 20 are adjusted with the running web. The invention further proposes that with constant tubular properties the pressure in the pneumatic cylinder 33 can be kept constant by supply or release of the compressed air independently from the tubular width. Then, according to the tubular width a suitable position of the blade 20 can be adjusted on the guidance rail 23 by which the blade 20 has an effect on the tubular web 11 with an optimal tensile force K for cutting of the tubular web 11. The device 10 according to the invention thereby comprises the pressure regulator 35 in order to regulate the pressure in the pneumatic cylinder 33. When with constant tubular properties the pressure in the pneumatic cylinder 33 is kept constant the tensile force K at the blade 20 remains likewise mainly constant. Advantageously, therewith an improved cutting result can be achieved.

The invention thereby assumes that the pulling device 30 adjusts the blade 20 to the left when the tubular width at the tubular web 11 is increased. If however the tubular width of the tubular web 11 decreases, the blade 20 is adjusted to the right simply by the tubular web 11. The pneumatic cylinder 33 enables further in dependence of the tubular properties a very exact adjustment of the tensile force K with which the blade 20 can influence the tubular web 11 in order not to rupture the tubular web 11. The transmission mechanism 31, 32 serves for the fact that at the same time the blade 20 can be adjusted relatively far to the left and right on the guidance rail 23 in order to be able to cut the tubular webs 11 in different widths. Advantageously, the device 10 according to the invention comprises simple components which are cost efficient and uncomplicated in assembly.

REFERENCE LIST

10 Device
11 Tubular web
12 Flat web
13 Flat web
14 Folding edge of the tubular web
15 Deflection roller
20 Blade
21 First blade element
22 Second blade element
23 Guide rail
24 First round plate
25 Second round plate
26 First cutting edge
27 Second cutting edge
30 Pulling device
31 Transmission mechanism/rotary disc
32 Transmission mechanism/rotary disc
31 First belt idler
32 Second belt idler
33 Pneumatic cylinder
34 Compressed air connection
35 Pressure regulator
36 Piston rod
37 Sensors
40 Housing

41 First deflection roller
42 Second deflection roller
I First drag rope
II Second drag rope
L Running direction of the tubular web
K Tensile force

What is claimed is:

1. A device for cutting a tubular web comprising:
an adjustable blade for cutting the tubular web; and
a pulling device, comprising:
a pneumatic cylinder, which pulls the blade to impinge a tensile force on a folding edge of the tubular web,
a transmission mechanism,
a first drag rope mechanically connecting a piston rod of said pneumatic cylinder to said transmission mechanism, and
a second drag rope mechanically connecting said transmission mechanism to the blade;
wherein the tensile force is automatically adjusted by the pneumatic cylinder by a movement of said adjustable blade caused by a change of a tubular width of the tubular web, wherein said movement is propagated to said piston rod through said second drag rope, said transmission mechanism and said first drag rope.

2. The device according to claim 1, wherein the transmission mechanism is a rotary disc having a first belt idler on which the first drag rope is coiled and a second belt idler on which the second drag rope is coiled.

3. The device according to claim 2, wherein the first belt idler comprises a diameter which is smaller than a diameter of the second belt idler.

4. The device according to claim 1, further comprising sensors which monitor the tubular width and are operatively connected to the pneumatic cylinder,
wherein the pulling device is automatically controlled by adjusting the pressure in the pneumatic cylinder, according to the tubular width alterations of the tubular web.

5. The device according to claim 1,
wherein the pulling device pulls the blade to impinge a tensile force on the folding edge of the tubular web if the tubular width of the tubular web is increasing.

6. The device according to claim 1, further comprising a first deflection roller having a groove that receives the first drag rope, wherein the first drag rope received in the groove of the first deflection roller is aligned with the pneumatic cylinder, and a second deflection roller having a groove that receives the second drag rope, wherein the second drag rope received in the groove of the second deflection roller is aligned perpendicularly to the blade and parallel to a guidance rail that guides the blade.

7. A device for cutting a tubular web comprising:
an adjustable blade for cutting the tubular web;
a pulling device, comprising:
a pneumatic cylinder and a pressure regulator which regulates a pressure in the pneumatic cylinder, said pulling device pulls the blade to impinge a tensile force on a folding edge of the tubular web,
a transmission mechanism,
a first drag rope mechanically connecting a piston rod of said pneumatic cylinder to said transmission mechanism, and
a second drag rope mechanically connecting said transmission mechanism to the blade; and
at least one sensor which monitors a tubular width of the tubular web and is operatively connected to the pneumatic cylinder;
wherein the tensile force is automatically adjusted by the pneumatic cylinder by a movement of said adjustable blade caused by a change of the tubular width of the tubular web, wherein said movement is propagated to said piston rod through said second drag rope, said transmission mechanism and said first drag rope.

* * * * *